US006147332A

United States Patent [19]

Holmberg et al.

[11] Patent Number: 6,147,332

[45] Date of Patent: Nov. 14, 2000

[54] ARRANGEMENT AND METHOD FOR MANUFACTURING OF A HEATABLE SEAT

[75] Inventors: Lennart Holmberg, Falköping; Kenneth Skogward, Huskvarna; Göran Forslund, Koppom, all of Sweden

[73] Assignee: Kongsberg Automotive AB, Sweden

[21] Appl. No.: 09/214,741

[22] PCT Filed: Jun. 30, 1997

[86] PCT No.: PCT/SE97/01177

§ 371 Date: Jan. 11, 1999

§ 102(e) Date: Jan. 11, 1999

[87] PCT Pub. No.: WO98/03040

PCT Pub. Date: Jan. 22, 1998

[30] Foreign Application Priority Data

Jul. 12, 1996 [SE] Sweden ..... 9602770

[51] Int. Cl.[7] ..... H05B 3/06

[52] U.S. Cl. ..... 219/526; 219/527; 219/217

[58] Field of Search ..... 219/201, 202, 219/209, 210, 217, 385, 521, 526, 527, 536, 544, 546; 29/729, 744, 745, 755, 825, 846, 848; 174/251; 297/180.12

[56] References Cited

U.S. PATENT DOCUMENTS

| | | | |
|---|---|---|---|
| 1,276,150 | 8/1918 | Wirt . | |
| 3,835,290 | 9/1974 | Peters | 219/526 |
| 4,316,605 | 2/1982 | Zachry et al. | 29/744 |
| 4,352,008 | 9/1982 | Hofer et al. | 219/526 |
| 4,506,138 | 3/1985 | Bennett et al. | 219/526 |
| 4,869,550 | 9/1989 | Lorenzen et al. . | |
| 4,962,295 | 10/1990 | Gilmore | 219/217 |
| 5,138,133 | 8/1992 | Sakurada et al. | 219/526 |
| 5,181,312 | 1/1993 | Gross | 29/744 |
| 5,611,139 | 3/1997 | Chelluri et al. | 29/744 |
| 5,915,749 | 6/1999 | Baldwin | 29/744 |

*Primary Examiner*—Teresa Walberg
*Assistant Examiner*—Fadi H. Dahbour
*Attorney, Agent, or Firm*—Lerner, David, Littenberg, Krumholz & Mentlik, LLP

[57] ABSTRACT

A heatable seat includes a heat-producing component with an electrical conductor and a connection for current seating organs. The heat-producing component is arranged in connection to a tool for shaping the heatable seat. The tool includes at least one magnet, and the heat-producing component includes magnetic material for detachable attachment to the at least one magnet.

15 Claims, 4 Drawing Sheets

ARRANGEMENT AND METHOD FOR MANUFACTURING OF A HEATABLE SEAT

TECHNICAL FIELD

The present invention relates to an arrangement for manufacturing a heatable seat. In particular, the invention can be applied in connection with motor vehicles when manufacturing electrically heatable seats in the vehicle. The invention also relates to a method in connection with the manufacturing of such a heatable seat.

BACKGROUND OF THE INVENTION

For reasons of comfort and safety, modern vehicles use electrically heatable vehicle seats. The drivers seat, as well as the other seats in the vehicle, can be so arranged that they can be heated by means of special heating elements which comprise electrically conducting wires, which are placed in the shape of heating coils in each seat. Such a heating element is normally placed in the cushion and the back-rest of the seats when they are manufactured. Furthermore, the heating element is connected to a current feeding unit which delivers current. In this way, the heating element can be heated to a suitable temperature.

One method of manufacturing vehicle seats with heating elements is to first place the heating element in a tool intended for manufacturing the padding of the seat. This manufacturing is normally done by means of so-called cold foaming, which is a previously known manufacturing method for producing soft elastic plastic foam. When using this method, the heating element is first placed in the tool, subsequent to which the components of the cold foaming process are supplied and are allowed to react in such a way that the padding of the seat can be shaped.

A problem in connection with cold foaming is that there is a risk that the heating element is moved from its intended position in the cold foaming tool. To be more exact, there is a risk that the heating element is moved both when the components which are part of the process are supplied to the tool and also during the cold foaming process itself, when the foam "ferments" and is shaped by the tool.

In order to solve this problem, the heating element can be equipped with surrounding supporting materials. From U.S. Pat. No. 4,869,550, a heating element is previously known which comprises a supporting material and an isolated heat conductor which is secured to the supporting material by means of securing organs in a pattern, and which covers a surface of the supporting material so that the supporting material forms a net-pattern with large meshes of essentially electrically isolating perforated material. During manufacture, the heating element with its supporting material is placed in a negative form for a vehicle seat. The form is filled with plastic foam in such a way that the heating element with its supporting material is surrounded by said plastic foam. Points of binding material on the supporting material of the heating element attach the heating element to the upholstery material of the vehicle seat and prevent it from being moved out of place. The shaping of the flat heating element with its net-shaped supporting material enables the plastic foam to penetrate and surround the heating element with an essentially constant density of the stiffened plastic foam. In this way, hardened portions in the foam, and uneven heating of the vehicle seat can be avoided.

In connection with conventional manufacturing of heating elements with net-shaped supporting materials, the supporting material is delivered in the form of rolls or sheets. Pieces of material with the desired dimensions are die-cut from the supporting material. This die-cutting of pieces of supporting material for individual heating elements generates large amounts of waste in the form of pieces of supporting material which are not used, thus causing unnecessary costs. With contemporary technology, 20–25% of the supporting material is lost as waste, which of course is a drawback when using this previously known manufacturing method.

Another drawback when using heating elements with net-shaped supporting materials is that the user perceives a certain stiffness or inflexibility of the manufactured vehicle seat. When manufacturing the vehicle seats, such a net-shaped supporting material can also be too stiff to allow the heating elements to be shaped to the shape of the seat in a desired manner and to be fixed in the desired position. For this reason, it might be desirable to die-cut chosen portions which are located inside the outer contour of the pieces of supporting material as heating elements, in order to obtain portions without supporting material, which facilitates shaping and folding of the heating element. Such a die-cutting will also result in unwanted pieces of unused supporting material.

A further drawback of net-shaped materials is that they have a tendency to interfere with the foaming process and to cause, for example, blisters in the resulting padding material.

The above-mentioned drawbacks are normally caused by the net-shaped supporting material being too densely formed. However, the supporting material must have a certain density, and can thus not be shaped with an arbitrary sparsity if the desired properties are to be obtained.

SUMMARY OF THE INVENTION

A main object of the present invention is thus to provide improved manufacturing of a heatable seat, in which the above-mentioned drawbacks have been eliminated. This is obtained by means of an arrangement, the characteristics of which can be found in appended claim 1. The object is also obtained by means of a method, the characteristics of which can be seen in appended claim 9.

The invention is intended for the manufacturing of a heatable seat which comprises a heat-producing component which in turn comprises an electrical conductor and a connection for power feeding organs. Furthermore, during manufacture, the component is placed in a tool for shaping of the seat. The invention is based on the principle that said tool comprises at least one magnet, and that the heat-producing component comprises magnetic material for detachable attachment to said magnet. In this way, a secure attachment of the heat-producing component is obtained during the manufacturing process itself when the seat is shaped, subsequent to which the finished seat together with the heat-producing component in a simple manner can be detached from the tool. The invention also enables production costs to be kept low.

Advantageous embodiments will become evident from the appended dependent claims. In a particular embodiment, the heat-producing component is shaped as a loop, and special connecting elements are utilized to fix the shape of the heat-producing component during transport, use, manufacturing, and handling.

The term "heat-producing component" in this context refers to that unit for heating which is intended to be placed in a seat, and which comprises one or more electrical conductors and, where applicable, one or more covers which can be made of electrically isolating material and which can comprise magnetic material. The term "heating element" in this context refers to that unit which is made up by the heat-producing component and by the above-mentioned connecting elements which are utilized to fix the shape of the heat producing component.

BRIEF DESCRIPTION OF THE DRAWINGS

The invention will in the following be described in connection to preferred embodiments and the appended drawings, in which.

PREFERRED EMBODIMENTS

Figure 1:
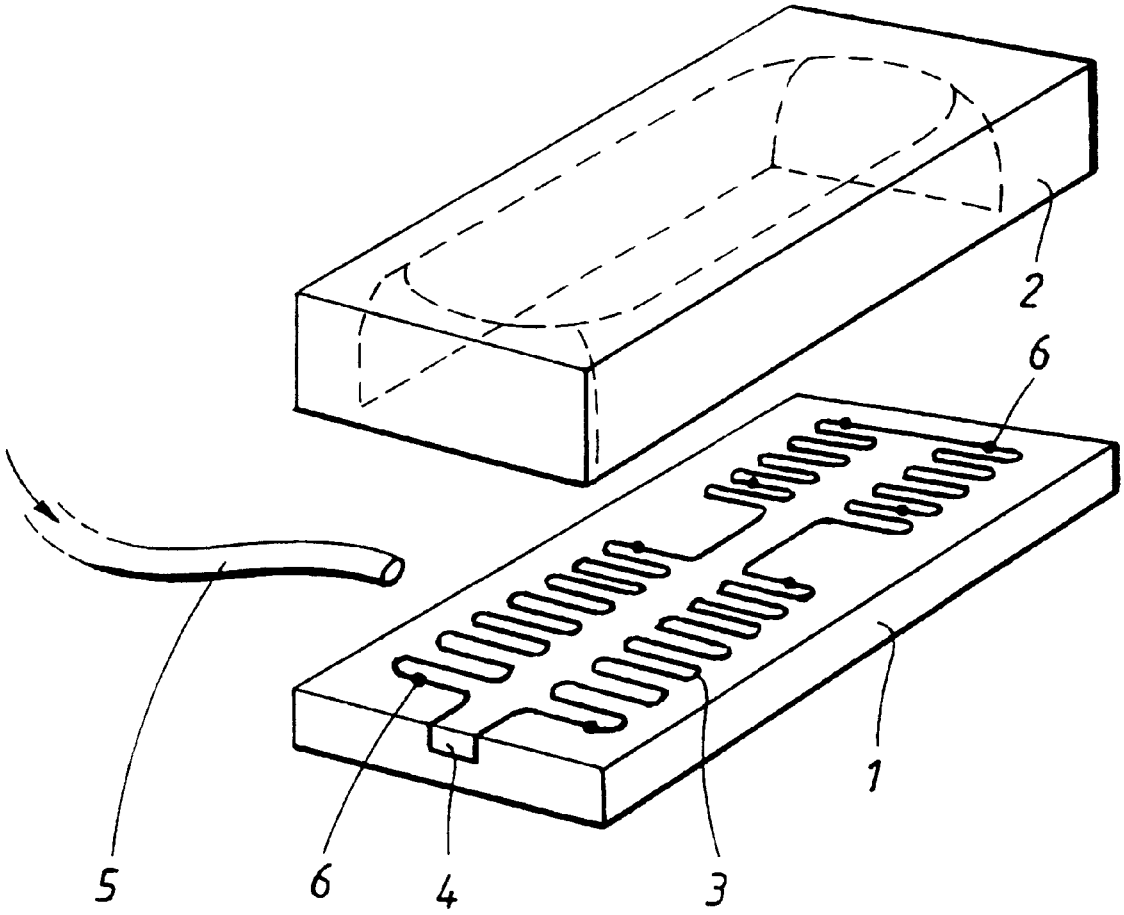
FIG. 1 is a simplified perspective view of an arrangement which can be utilized when manufacturing vehicle seats.

FIG. 1 shows a highly simplified perspective view of an arrangement which can be utilized in connection with the invention. To be more precise, the arrangement can be utilized for the manufacturing of parts for a vehicle seat, e.g. its cushion or back-rest. Furthermore, the arrangement is intended to be used in connection with so-called cold foaming, which as such is a previously known method for producing soft elastic urethane plastic foam. Cold foaming is common when manufacturing padding materials or cushions, mattresses, etc. and is based on the mixing of certain predetermined components, which react together in such a way that foaming takes place. The reaction takes place at a relatively low temperature, preferably in a specially shaped moulding tool. During the cold foaming process, a "fermentation" takes place, by means of which the finished plastic material is shaped in the form. FIG. 1 shows one such tool for cold foaming, which comprises a lower tool part 1 and an upper tool part 2. According to the figure, the upper tool part 2 is shaped with an internal moulding form which corresponds to the shape of a vehicle seat. Alternatively, the lower tool part 1, or both of the tool parts 1, 2, can also be shaped as a moulding form for the vehicle seat.

When manufacturing an electrically heatable vehicle seat, a heating element 3 can be placed in the lower tool part 1 before the foaming process begins. This corresponds to the heating element 3 being positioned close to the surface layer of the upper surface of the manufactured vehicle seat. The heating element 3 consists of an electrically conducting coil which, during normal operation in a vehicle, is connected to a (not shown) current feeding unit. By means of this current feeding, the heating element can be heated to a suitable temperature. For this purpose, the heating element 3 comprises an electrical connection 4 for a current feeding unit.

Furthermore, the tool arrangement comprises a connection 5 for the supply of those components which together react and make up the finished plastic material. The connection 5 is preferably arranged in the shape of a conduit which has its muzzle between the two open tool parts 1, 2. When manufacturing the vehicle seat, the connection 5 can be positioned in a correct manner e.g. by means of a (not shown) robot, following which components in question are injected. Subsequent to the injection, the two tool parts 1, 2 are closed, after which the cold foaming process can continue.

As has been described initially, during the cold foaming process it is extremely essential for the heating element 3 to be fixed in its intended position. Due to this desire, it is a basic principle of the invention to hold the heating element 3 in place magnetically when manufacturing the seat. For this purpose, the lower tool part 1 is provided with a number of magnets 6 which are arranged in the surface layer of the lower tool part 1. The magnets 6 here interact with the heating element 3, which is formed so that it is magnetic, as will be described in detail below. The magnets 6 can be arranged in many various ways, but are suitably distributed at equal distances in the lower tool part 1 along the coil which is formed by the heating element 3. Furthermore, the magnets 6 are preferably shaped with dimensions which correspond to the dimensions of the coil of the heating element 3.

Figure 2:
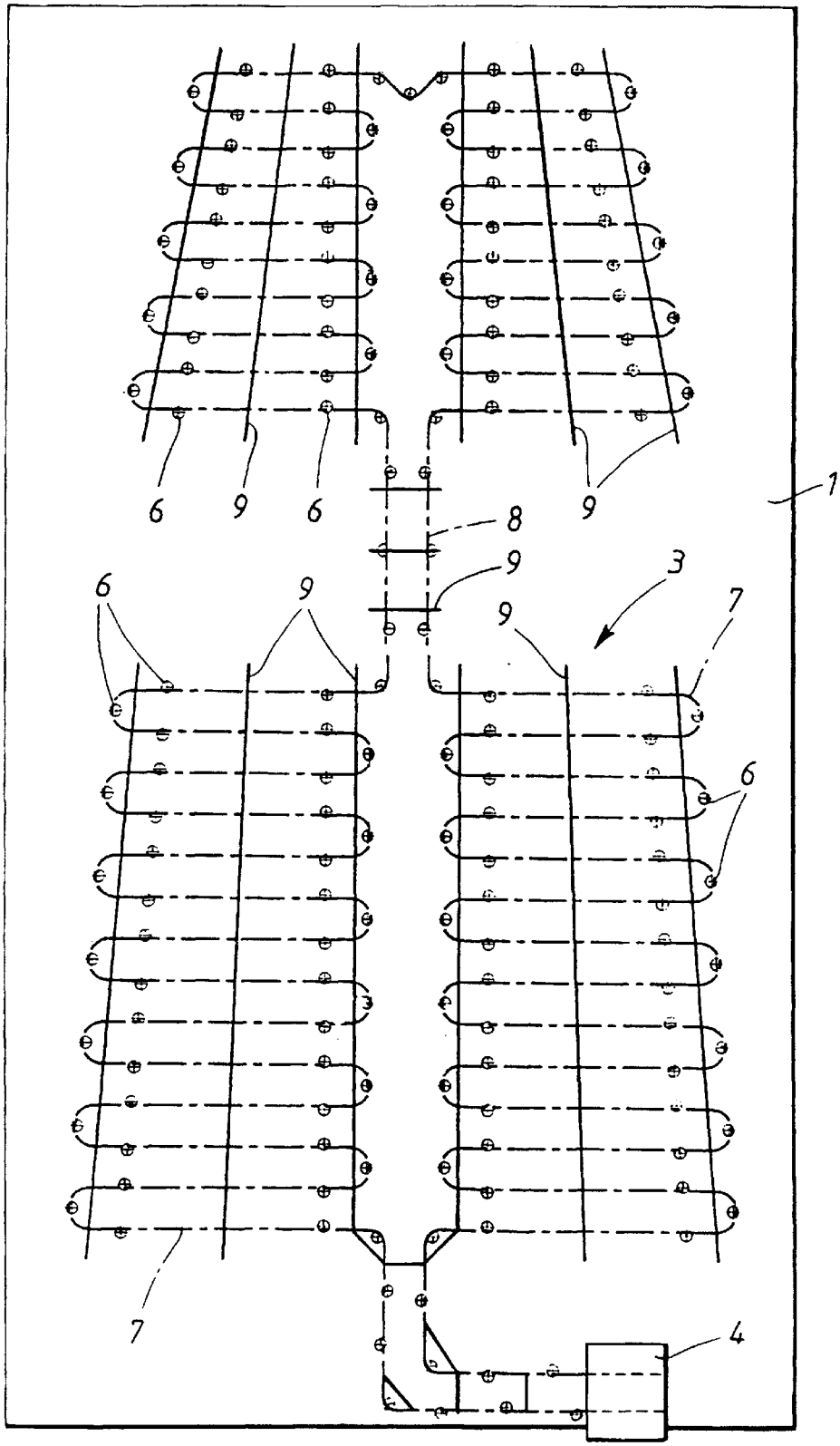
FIG. 2 is a top view of a heating element intended to be utilized in connection with the present invention.

FIG. 2 is a top view, which shows in closer detail how a heating element 3 according to the invention is positioned in the lower tool part 1. According to the invention, the heating element 3 is intended to be arranged in the cushion of a vehicle seat. For this purpose the heating element 3 comprises a heat-producing component 7, which will be described in closer detail below, and which is positioned as a coil, the position of which corresponds to the positions of a number of magnets 6 which are arranged in the lower tool part 1. The heat-producing component 7 is, according to the embodiment, provided with a mid-section 8, the shape of which corresponds to a recess in the manufactured seat. Furthermore, it can be seen in the figure that the heat-producing component 7 is connected to an electrical connection 4 for the connection of an external (not shown) current feeding unit.

According to the embodiment, the heat-producing component 7 is provided with connecting elements in the form of essentially straight and wire-shaped elements 9. The connecting elements 9 are preferably made from elastic materials, e.g. polymeric material and are fixed to the heat-producing component 7 by means of welding, gluing or any other suitable attachment method. The purpose of the connection of the connecting elements 9 is to fix the shape of the heat-producing component 7 during transport and handling, and during the cold foaming process.

Figure 3:
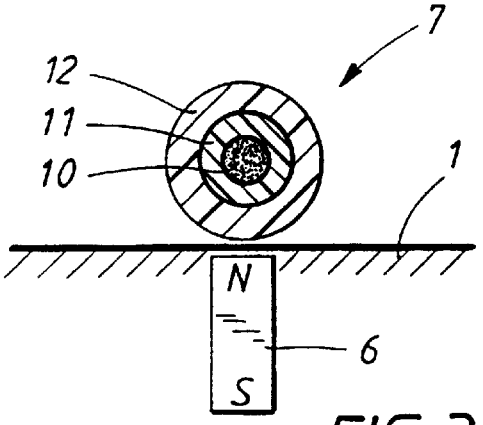
FIG. 3 is a cross-sectional view of a heat-producing component which is intended for the present invention in a first embodiment.

According to the invention, the heat-producing component 7 is fixed by means of magnetic force during the cold foaming process. For this purpose, it is formed so that it is magnetic. FIG. 3 shows a cross-sectional view of the heat-producing component 7 according to a first embodiment. The figure shows the heat-producing component 7 placed on top of the lower tool part 1 (see FIGS. 1 and 2). In the lower tool part 1, there is arranged a number of magnets of which FIG. 3 shows one magnet 6. The magnet 6 in a known manner consists of a rod magnet which comprises a north and a south pole, where one of the poles is turned towards the heat-producing component 7.

The heat-producing component 7 consists of a core 10 of electrically conducting wires, so-called conductors. According to the embodiment, the core 10 consists of preferably about 10–100 conductors. During normal operation in a vehicle, current is fed through the core 10, which in a known manner will be heated. Around the core 10, there is a first cover in the form of an intermediate layer 11, which preferably consists of a plastic material, e.g. PVC or polyethylene plastic. Furthermore, the intermediate layer 11 is surrounded by a second cover in the form of an outer layer 12, which is made from a plastic material in which there is moulded magnetic material, preferably in the form of iron powder or iron chips, which is integrated with the material of the outer layer 12. Since the outer layer 12 in this way is magnetic, the heat producing component 7 can be held in position against the first tool part 1 by means of magnetic effect.

The heat-producing component 7 is given a suitable stiffness, which provides a form-stability of the entire heating element during transport and positioning in the cold foaming tool. The stiffness is determined by the choice of material for the electrically conducting wires 10 and the stiffness of the respective covers 11, 12.

Figure 4:
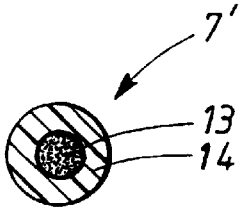
FIG. 4 is a cross-sectional view of a heat-producing component in a second embodiment.

FIG. 4 shows an alternative heat-producing component 7', according to a further embodiment. The figure does not show the first tool part or a magnet. The heat-producing component 7 here comprises a core 13 with a number of conductors, and a plurality of wires of magnetic material, e.g. magnetic wires of iron or an iron/nickel alloy. The core 13 is surrounded by a cover 14 of a plastic material, e.g. PVC plastic or polyethylene plastic. Furthermore, the cover 14 can also be provided with magnetic material, which preferably has been moulded into the material of the cover.

Figure 5:
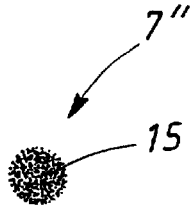
FIG. 5 is a cross-sectional view of a heat-producing component in a third embodiment.

FIG. 5 shows a heat-producing component 7" according to a further embodiment, which only consists of a number of conducting wires 15 arranged together with wires of magnetic material.

Figure 6:
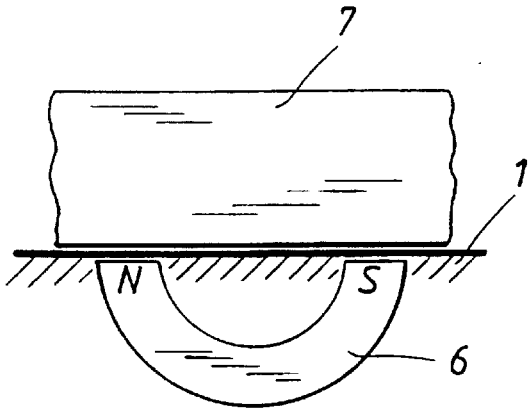
FIG. 6 is a side view of a further embodiment of the invention.

FIG. 6 shows an embodiment with an alternative positioning of the magnets in the lower tool part 1. The figure is a side-view which essentially corresponds to that shown in FIG. 3, but which however shows an alternative arrangement for the magnet 6'. In order to obtain an improved retaining magnetic force, the magnet 6' is curved so that both its north and south poles face the heat-producing component 7. This provides a more concentrated magnetic force field in the area around the heat-producing component 7, and stronger forces for keeping it in place.

Figure 7:
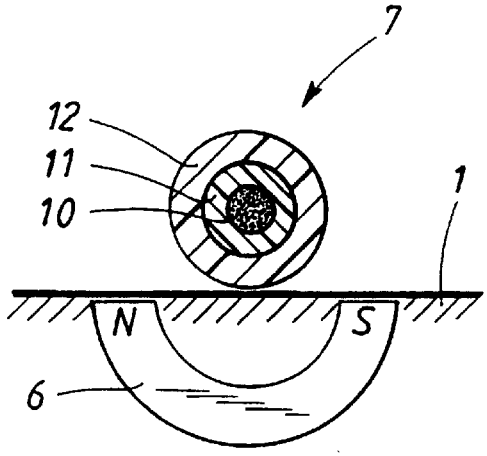
FIG. 7 is a side view of an alternative embodiment of the invention.

According to the embodiment shown in FIG. 6, the direction of the magnetic field is also changed relative to that shown in FIG. 3. This can be used when generating a magnetic force for the holding of a heat-producing component according to the embodiment shown in FIG. 7. This figure shows the lower tool part 1 which is provided with a curved magnet 6' of the same kind as shown in FIG. 6, but where the heat-producing component 7 has been positioned essentially perpendicular to the longitudinal direction of the magnet 6', i.e. essentially perpendicular to the direction of the magnetic field between the north and south poles. According to the embodiment, a magnetic force for fixing the heat-producing component 7 can be obtained by leading a current through its conductor 10 already when manufacturing the seat, i.e. during the cold foaming process itself. According to well known laws of physics, an electrical current which is fed through an electrical conductor causes a magnetic field around the conductor. In the embodiment in question, this current can be supplied by connecting a current feeding unit to the electrical connection 4 (see FIGS. 1 and 2). The magnetic field which is thus generated can be utilized in connection with the invention for detachable holding of the heat-producing component during the cold foaming process.

Figure 8:
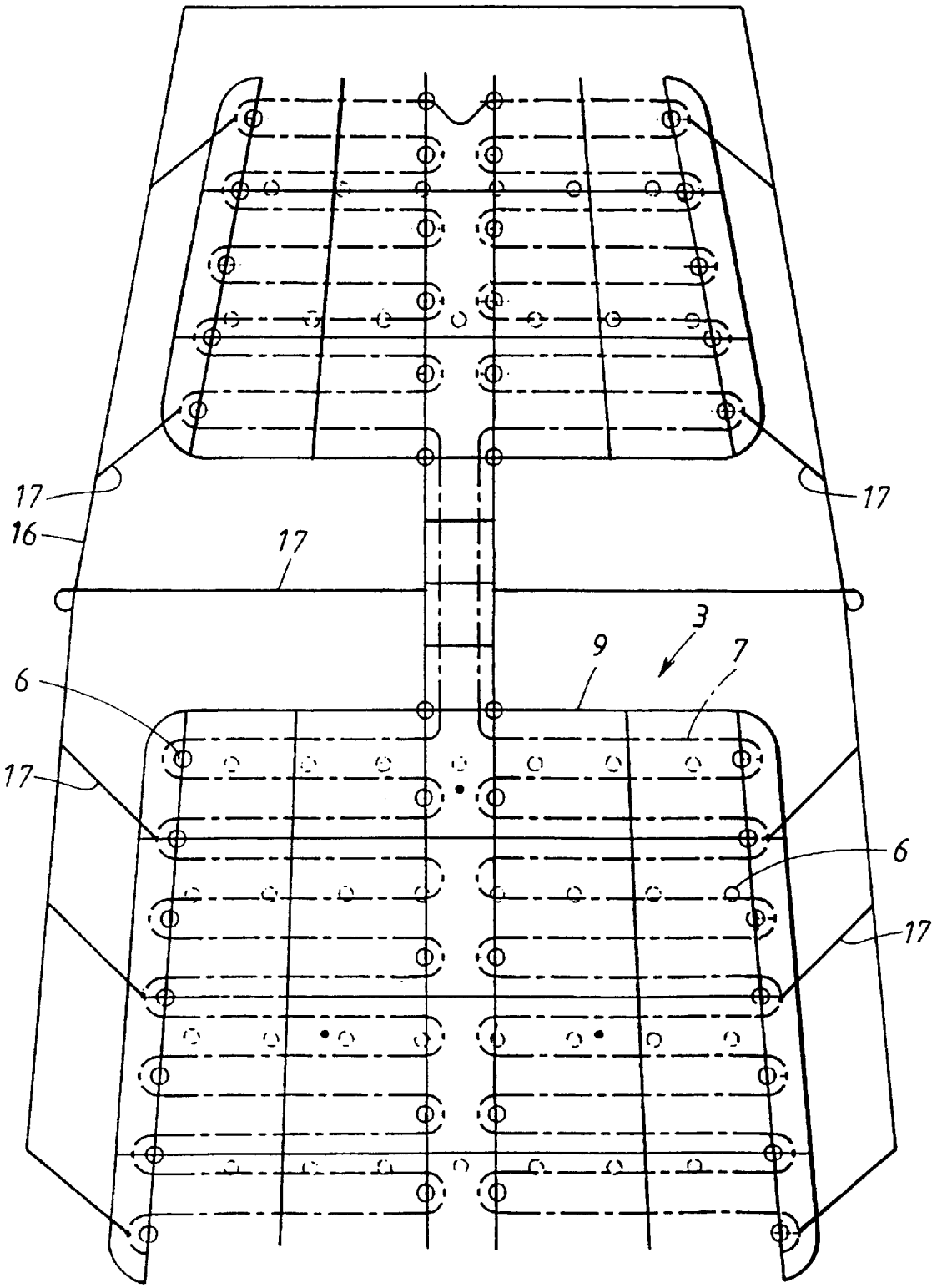
FIG. 8 is a top view of a heating element which is connected to a frame element in the shape of a rod.

FIG. 8 shows a heating element 3 which corresponds to that shown in FIG. 2, but in which the connecting elements 9 are shaped as a net-shaped element which is connected to an essentially U-shaped frame in the form of a rod 16. This rod 16 consists of a thin shaped metal rod which is utilized in the finished vehicle seat for holding seams. Normally, the rod 16 is intended to be placed higher in the tool than the heating element 3 when manufacturing a seat. For this purpose, the rod 16 is connected to the heating element 3 via further connecting elements 17 which essentially are of the same kind as the above-mentioned connecting elements 9 (see FIG. 2). In this way, the entire arrangement can be manufactured and handled as a flat unit which is given a three-dimensional shape when positioning it in the tool. As can be seen in the drawing, the connecting elements 9 are so arranged that they are at an oblique angle relative to the extension of the heating element, i.e. to the extension of the seat. This enables the entire unit to be flat during transport, and to be given its three-dimensional shape when positioning it in the tool part 1.

Generally, according to the invention, when the cold foaming process is to be carried out in connection with the manufacturing of a vehicle seat the heating element 3 is first positioned correctly. It is thus kept in place by the force of the respective magnets 6. Following this, the second tool part 2 is positioned correctly relative to the first tool part 1, subsequent to which the cold foaming process takes place. Since the heat-producing component 7 is held securely in place due to magnetism, its position on the finished vehicle seat will be secured. After the cold foaming has been finished, the upper tool part 2 can be lifted up, following which the finished seat including the heating element 3 is detached from the magnets 6.

According to a further embodiment, the magnets which have been described above can be replaced with an electromagnetic arrangement, in which coils are fed with a current and thus in a known manner generate the necessary magnetic force.

The invention is not limited to that which has been described above, but various embodiments are possible within the scope of the claims. For example, the invention can in principle be utilized for heating other seats than vehicle seats. Also, the number of magnets 6, 6' and their positioning in the tool can vary. The shape of the tool parts can also vary. However, the tool does comprise some form of magnetic element, for example in the lower tool part 1, for temporary holding of the heating element 3.

The arrangement according to the invention can be combined with a net-shaped supporting material as has been described initially. A major advantage of the invention is then that the supporting material does not need to be made magnetic, since the heat-producing component instead comprises magnetic material. This enables the supporting material to be minimized or even to be completely excluded.

The invention is not limited to use in connection with a cold foaming process, but can be used in other manufacturing processes. For example, the magnetic force can be utilized to temporarily hold the heat-producing component when it is being sewn into a seat.

What is clamed is:

1. Arrangement for manufacturing a heatable seat comprising a heat-producing component with an electrical conductor and a connection for current feeding organs, in which said component is placed in a tool for the shaping of said seat, wherein said tool comprises at least one magnet, and said heat-producing component comprises magnetic material for detachable attachment to said magnet.

2. Arrangement according to claim 1, in which the heat-producing component comprises an electrically isolating cover, wherein said magnetic material is arranged integrated with said cover.

3. Arrangement according to claim 1 or 2, wherein said magnetic material is arranged integrated in said conductor.

4. Arrangement according to claim 1, wherein said magnet is shaped as a rod-magnet, the north and south poles of which are turned towards said heat-producing component.

5. Arrangement according to claim 4, claim 1, wherein wherein said heat-producing component is arranged with an extension which is essentially perpendicular to the direction of the magnetic field between said north and south poles, and is connected to said current feeding organs during said manufacturing, whereby a magnetic field is generated due to the current feeding.

6. Arrangement according to claim 1, wherein said heat-producing component is formed as a coil, the shape of which is fixed by means of connecting element which are connected to said component in a plurality of positions.

7. Arrangement according to claim 1, wherein said heat-producing component is connected to a frame element via connecting organs.

8. Arrangement according to claim 6, wherein said connecting organs are obliquely arranged relative to the longitudinal direction of said seat.

9. Method for manufacturing a heatable seat comprising a heat-producing component with an electrical conductor and a connection for current feeding organs, in which said heat-producing component is positioned in connection to a tool for the shaping of said seat, wherein said heat-producing component is detachably held during said forming by means of magnetic force.

10. The method according to claim 9, wherein said magnetic force is obtained by the use of a heat-producing component with an integrated magnetic material during manufacturing.

11. The method according to claim 9, wherein said magnetic force is obtained by connecting said current feeding organ to said heat-producing component during manufacturing, where current is fed through said conductor and a magnetic field is generated.

12. The method according to any of the claims 9–11, wherein the heat-producing component before said manufacturing, is connected to a frame element via connecting organs.

13. The method according to claim 12, wherein said connecting organs are obliquely arranged relative to the extension of said seat so that an essentially three-dimensional form of the frame element together with the heat-producing component is formed during said manufacturing during manufacturing, where current is fed through said conductor and a magnetic field is generated.

14. The method according to claim 13, wherein said manufacturing comprises a cold foaming process.

15. The method as claimed in claim 9, wherein said manufacturing comprises a cold foaming process.

* * * * *

UNITED STATES PATENT AND TRADEMARK OFFICE

CERTIFICATE OF CORRECTION

PATENT NO. : 6,147,332

DATED : Nov. 14, 2000

INVENTOR(S) : Holmberg et al.

It is certified that error appears in the above-identified patent and that said Letters Patent is hereby corrected as shown below:

Col. 1, line 14, change "drivers" to --driver's--.
Col. 1, line 63, change "seat" to --seat,--.
Col. 3, line 8, change "will in the following" to --will, in the following,--.
Col. 5, line 24, change "7" to --7'--.
Col. 5, line 61, change "well known" to --well-known--.
Col. 7, line 13, delete "claim 1, wherein".
Col. 7, line 22, change "element" to --elements--.
Col. 8, line 16, change "component" to --component,--.
Col. 8, line 25, delete "during manufacturing".

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*